US006210724B1

(12) United States Patent
Clarke et al.

(10) Patent No.: US 6,210,724 B1
(45) Date of Patent: Apr. 3, 2001

(54) TEMPERATURE-RESPONSIVE CONTAINERS

(75) Inventors: Raymond Clarke, Los Altos; Andrew W. Larson, Livermore; Steven James, Hillsborough, all of CA (US)

(73) Assignee: Landec Corporation

( * ) Notice: Subject to any disclaimer, the term of this patent is extended or adjusted under 35 U.S.C. 154(b) by 0 days.

(21) Appl. No.: 09/379,305

(22) Filed: Aug. 23, 1999

(51) Int. Cl.[7] ..... B65D 81/24; B65D 85/00

(52) U.S. Cl. ..... 426/118; 426/107; 426/106; 426/415; 426/395; 428/913

(58) Field of Search ..... 426/118, 395, 426/415, 419, 106, 396, 107; 383/100, 102, 103, 45, 211; 220/201, 913; 428/63, 200, 136, 913

(56) References Cited

U.S. PATENT DOCUMENTS

| | | | | |
|---|---|---|---|---|
| 3,386,837 | * | 6/1968 | Arnot | 426/134 |
| 4,769,262 | * | 9/1988 | Ferrar et al. | 428/35 |
| 4,830,863 | | 5/1989 | Jones | 426/118 |
| 5,412,035 | * | 5/1995 | Schmitt et al. | 525/93 |
| 5,428,209 | * | 6/1995 | Babu et al. | 219/730 |
| 5,443,851 | | 8/1995 | Christie et al. | 426/88 |
| 5,672,406 | * | 9/1997 | Challis et al. | 428/136 |
| 5,783,302 | * | 7/1998 | Bitler et al. | 428/343 |

FOREIGN PATENT DOCUMENTS

| | | | |
|---|---|---|---|
| WO 92/16434 | 10/1992 | (WO) | B65D/81/24 |
| WO 92/21588 | 12/1992 | (WO) | B65D/81/20 |

* cited by examiner

*Primary Examiner*—Gabrielle Brouillette
*Assistant Examiner*—Robert Madsen
(74) *Attorney, Agent, or Firm*—Sheldon & Mak

(57) ABSTRACT

Sealed packages of foodstuffs which are biological materials, particularly fruit, are vented by a temperature-sensitive control unit. The control unit covers an aperture in a wall of the package. The control unit includes a barrier member which is secured over the aperture by a layer of temperature sensitive adhesive, and a force member which lifts the barrier member away from the aperture when an increase in temperature weakens the adhesive. The force member is preferably elastically deformed.

18 Claims, 4 Drawing Sheets

TEMPERATURE-RESPONSIVE CONTAINERS

BACKGROUND OF THE INVENTION

1. Field of the Invention

This invention relates to containers with temperature-sensitive properties, particularly for packaging fresh fruit and other foodstuffs.

2. Introduction to the Invention

It is well known to package objects in sealed containers. When biological materials are packaged, it is desirable that the atmosphere within the container should be correlated with the stored material and the storage temperature. For materials to be stored below room temperature, the desired atmosphere is low in oxygen, because this minimizes the production of pathogens. One technique for producing the desired modified atmosphere is to use a container having one or more atmosphere-control members (ACMs) whose permeability to gases is substantially greater than the rest of the container. An ACM can be, for example, composed of a microporous film, optionally coated with a thin layer of a polymer. Another technique is to fill the container, before it is sealed, with a desired mixture of gases. Reference may be made for example to U.S. Pat. Nos. 4,734,324 (Hill), 4,830,863 (Jones), 4,842,875 (Anderson), 4,879,078 (Antoon), 4,910,032 (Antoon), 4,923,703 (Antoon), 5,045,331 (Antoon), 5,160,768 (Antoon) and 5,254,354 (Stewart); copending, commonly assigned Application Serial No.09/121,082; International Publication Nos. WO 96/38495, and WO 99/12825; and European Patent No.676920, and European Patent Applications Nos. 0,351,115 and 351,116 (Courtaulds). The entire disclosure of each of those documents is incorporated herein by reference for all purposes.

SUMMARY OF THE INVENTION

Various problems can arise when the temperature within a sealed container becomes excessive. With biological materials, especially fruit, the low level of oxygen which is desirable at low temperatures can be dangerous at higher temperatures, because it promotes the production of pathogens. This is particularly dangerous when visual inspection does not reveal the presence of such pathogens. For example, cut melons which have been stored at room temperature in a sealed package can appear fresh even when high concentrations of pathogens are present. Another problem is that when a package of biological materials is filled with a mixture of gases at the time of packaging, in order to provide a desired atmosphere at that time, changes in the biological materials after they have been packaged can make the mixture of gases undesirable after a day or two (or more). A different problem arises when microwaves are used to cook a foodstuff in a sealed package, thus generating dangerously high temperatures and pressures within the package.

The present invention solves such problems by providing a simple and effective way of venting a sealed package when it reaches an excessive temperature and/or after a particular time. The invention can also be used to increase the rate at which gases can pass out of and into a sealed container, in response to an increase in temperature, without opening the container. The invention can also be used to provide an indication of the thermal history of a sealed package or other article.

The invention makes use of a temperature-sensitive cover unit which is secured to a wall of the container. The cover unit includes a barrier member which covers a window in the wall. Usually, the barrier member prevents all gases from passing through the window; however the invention includes the possibility that the barrier member has limited permeability to gases. The window is usually a simple aperture, but can be an atmosphere-control member. The barrier member is secured over the window by a layer of adhesive which is selected so that it loses adhesive strength when it is heated to the elevated temperature at which the container is to be vented. The cover unit also contains a base member and a force member. The base member is secured to the container. The force member, at the desired elevated temperature, changes shape and causes the barrier member to move so that at least part of the window is opened to the ambient atmosphere. Preferably, the base, barrier and force members are adjacent parts of a single component, e.g. a strip of polymeric material. However, many other possibilities exist. For example, the base, force and barrier members can be indistinguishable parts of the same member, or the force and barrier members can be indistinguishable parts of the same member.

The force member is preferably elastically deformed, in which case the container is vented when the elastic recovery forces exceed the adhesive forces. Alternatively, the force member can be stable at lower temperatures, but be heat-recoverable (i.e. tend to change shape) at an elevated temperature equal to or below the temperature at which the container is to be vented. The adhesive bond generally fails over a period of time which depends on the temperature. Thus, the bond will fail slowly, if at all, at relatively low temperatures and more rapidly as the temperature increases. This makes it possible to use the control unit to vent a package (e.g. a gas filled package) after a desired period of time at a relatively low temperature.

If it is observed that the barrier member is no longer secured over the window, this indicates that the package has passed through a time-temperature regime sufficient to cause the barrier member to be pulled away from the window, even if the temperature at the time of observation is relatively low. This makes it possible use the cover unit to indicate the thermal history of a sealed package. It is also possible to use certain cover units to provide an approximately quantitative indication of the thermal history of a sealed package. In a cover unit to be used in this way, there are two additional requirements. First, the barrier member must be secured to the base member by a layer of adhesive which has an axis of substantial length. Second, the recovery forces which are generated by the force member must tend to peel the barrier member away from the base member along a line at an angle, preferably at a right angle, to the axis. In this way, at any particular time, the length of the barrier member which has peeled away from the base member is an indication of the thermal history of the article. When the cover unit is used solely as an indicator of thermal history, as discussed above, it can be used with any article, since its value does not depend on the presence of an aperture in the package or other article.

In a first aspect, this invention provides a sealed package including a cover unit as described above. Such a package, for example, comprises (A) a sealed container which defines an interior space, and (B) an object within the interior space;

the sealed container comprising (1) walls which (a) define the interior space, and (b) contain a window through which gases can pass into or out of the interior space; and (2) a temperature-sensitive cover unit which comprises
  (a) a base member which is secured to a wall of the container,
  (b) a barrier member which is secured over the window and reduces the rate at which gases pass through the window,
  (c) a layer of an adhesive which secures the barrier member over the window, and which loses adhesive strength if it is heated from the first temperature to an elevated temperature, and
  (d) a force member which, when the cover unit is heated from the first temperature to the elevated temperature, changes shape and causes the barrier member to move so that it uncovers at least part of the window, thereby increasing the rate at which gases pass through the window.

It should be noted that such a package may be vented after an extended time (e.g. 12 to 72 hours) at the first temperature (i.e. without any increase in temperature), because the adhesive bond fails through creep of the adhesive securing the barrier member over the aperture.

In a second aspect, this invention provides an empty container including a cover unit as described above or a precursor for a cover unit as described above, i.e. a cover unit which can be converted into the desired cover unit, preferably at or shortly before the time that the container is filled and sealed. Such a container, for example, comprises (1) walls which
  (a) when the container has been sealed around the object, define an interior space which contains the object, and
  (b) contain a window through which gases can pass into or out of the interior space; and
(2) a precursor cover unit which comprises
  (a) a base member which is secured to a wall of the container,
  (b) a barrier member which can be secured over the window and which, when it is secured over the window, reduces the rate at which gases pass through the window,
  (c) a layer of an adhesive which, when the barrier member is over the window, secures the barrier member over the window, and which loses adhesive strength if it is heated from the first temperature to an elevated temperature, and
(d) a force member which, when the barrier member is secured over the window and the cover unit is heated from the first temperature to the elevated temperature, changes shape and causes the barrier member to move so that it covers at most part of the window, thereby increasing the rate at which gases pass through the window.

In a third aspect, this invention provides novel cover units and precursor cover units which are preferably used in such packages and containers. Such a precursor unit, for example, comprises (1) a component comprising
  (a) a base member which can be secured to a wall of a container and which has an aperture through it,
  (b) a barrier member, and
  (c) a force member which is elastically deformable;
(2) a layer of a pressure-sensitive adhesive (PSA); and
(3) a release sheet covering the layer of adhesive;
  whereby, after the release sheet has been removed, the force member can be elastically deformed so that barrier member is secured to the base member by the PSA and covers the aperture in the base member;

In a fourth aspect, this invention provides methods of making such packages, containers, cover units and precursor cover units.

DETAILED DESCRIPTION OF THE INVENTION

Figure 1:
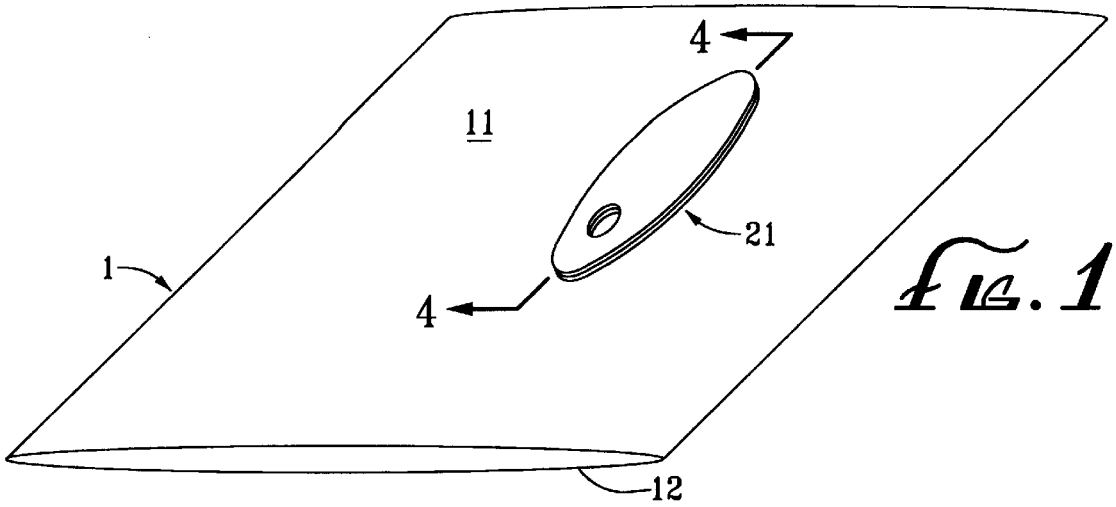
FIGS. 1–3 are diagrammatic views of a container (a plastic bag) when it is empty and has a precursor cover unit secured thereto (FIG. 1); when it is still empty, but after the cover unit has been activated (FIG. 2); and after it has been filled and sealed, and has thereafter been exposed to excessive temperature which has caused the barrier member to lift off the window (FIG. 3)

In the summary of the invention above, in the detailed description which follows, and in the accompanying drawings, reference is made to numerous specific features of the invention. It is to be understood that, although some features are described or illustrated only in a particular context, each such feature can also be used in combination with one or more other features described in general terms or in other particular contexts which do not clearly exclude that feature, and that all such combinations are part of the present invention.

In this specification, parts and percentages are by weight, except where otherwise noted. $T_o$ denotes the onset-of-melting point of a polymer, and $T_p$ denotes the peak melting point of a polymer, as measured by a differential scanning calorimeter at a rate of 10° C./minute and in the second heating cycle. $T_o$ and $T_p$ are measured in the conventional way well known to those skilled in the art. Thus $T_p$ is the temperature at the peak of the DSC curve, and $T_o$ is the temperature at the intersection of the baseline of the DSC peak and the onset line, the onset line being defined as the tangent to the steepest part of the DSC curve below $T_p$. The heat of fusion of a polymer is measured in the same way.

This invention is particularly useful for venting packages which contain foodstuffs, and will therefore be described chiefly by reference to such use. However, it is to be understood that the invention is also useful in a variety of other ways, as noted above.

The term adhesive is used broadly in the specification. It denotes any material which will secure the barrier member to the substrate to which the barrier member is secured, by a bond which is sufficiently strong at the storage temperature, but which weakens at the desired elevated temperature. Particularly useful adhesives comprise a crystalline polymer having a $T_p$ close to the elevated temperature at which the package is to be vented. Generally speaking, the adhesive will weaken substantially as soon has a substantial proportion of the crystals have melted, i.e. at a temperature below $T_p$, but above the onset of melting. In order to insure that the package does not open prematurely, the adhesive preferably melts over a narrow temperature range. It is preferred, therefore, that the polymer has an onset-of-melting temperature, $T_o$, such that $(T_p-T_o)$ is less than 10° C. and/or a heat of fusion of at least 5 J./g. It is also possible for the adhesive to be an amorphous polymeric material which softens over an appropriate temperature range. However, amorphous polymers soften over a wider temperature range than crystalline polymers, and thus do not give such reliable results.

When the foodstuff is a biological material, e.g. nectarines, peaches, cut melon pieces, or other fruit, the temperature at which the package should be vented is usually not more than than about 18° C., more often not more about 10° C. For packages containing such materials, it is desirable to use an adhesive comprising at least 50%, preferably at least 80%, especially about 100%, of a crystalline polymer having a $T_p$ of 2 to 20° C., preferably 2 to 10° C. Many polymers of this kind are well known and include in particular side chain crystalline (SCC) polymers. For details of such polymers, reference may be made for example to U.S. Pat. No. 5,412,035, the disclosure of which is incorporated herein by reference. Particularly useful are siloxane/SCC block copolymers of the type disclosed in copending, commonly assigned application Ser. No. 09/121,082, incorporated herein by reference. Also useful are pressure sensitive adhesives (PSAs) comprising (1) at least 50% of a polymeric PSA, and (2) an SCC polymer having a weight average molecular weight of less than 25,000. Such adhesives are described in detail in U.S. Pat. No. 5,254,354, incorporated by reference herein.

When the package contains a foodstuff to be cooked by microwaves, the temperature at which the package should be vented is much higher, for example in the range 60–90° C. For such use, therefore, the adhesive should melt (or soften) close to that range.

This invention is useful with a wide variety of containers. The container will generally be made of a polymeric material, but other materials can be used. The container can, but need not, contain an atmosphere-control member. It is necessary that when the force member changes shape, it should detach the barrier member from the wall, rather than deform the wall of the container. Therefore, when the wall is flexible (for example part of a plastic bag), it may be necessary to reinforce the wall in the vicinity of the aperture. This can conveniently be done by means of a base member which is secured to the wall of the container around the aperture and which makes the wall sufficiently rigid at that point. Even when the wall is sufficiently rigid, it may be desirable to make use of a base member in order to provide a cover unit which can be conveniently fixed in the right location, and/or to modify the shape of the container in the area of the aperture.

The cover units used in the present invention comprise a base member, a barrier member and a force member. These members are preferably adjacent parts of a single flat strip of material, preferably a polymeric material. The material is chosen so that when the strip is folded transversely about a central section, the central section is deformed elastically. As a result, the strip, when released, tends to unfold into its original flat configuration. One of the end portions is the base member, the other end portion is the barrier member, and the central section is the force member. The base member is secured to the container. Preferably it contains an aperture so that it can be secured over the aperture in the container. Alternatively, the strip can extend around a rounded edge of a container, e.g. a thermoformed box, with the base member secured to one wall of the box, the force member extending around the edge of the box, and the barrier member covering the aperture in the adjacent wall.

In another embodiment, the base, force and barrier members are combined into a single uniform member. This embodiment can, for example, make use of a flat polymeric sheet which is deformed around a curved substrate at an elevated temperature, and assumes the shape of the substrate. The curved sheet can be flattened out over the aperture, and be secured over the aperture by the adhesive. However, the polymeric sheet tends to return to its curved configuration, and does so when the adhesive weakens.

In another embodiment, a crystalline polymeric article having a first configuration is cross linked, heated above its melting point, deformed, and cooled in the deformed configuration. Such an article will tend to return to its first configuration if reheated above its melting point. The deformed article can, therefore, be secured over the aperture, optionally through a base member, and will remain in place until the adhesive has softened and the crystalline melting point has been exceeded.

In another embodiment, the barrier member is made up of two dissimilar polymeric sheets, the outer sheet shrinking at the desired venting temperature, and causing the sheet to curl up and become detached from the aperture.

The invention is illustrated in the accompanying drawings.

Figure 2:
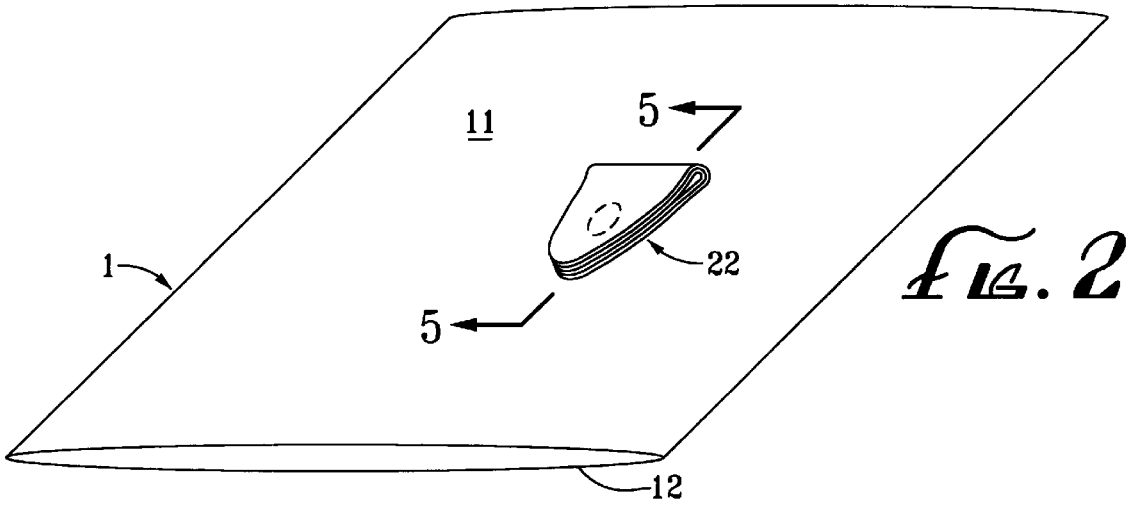
Figure 3:
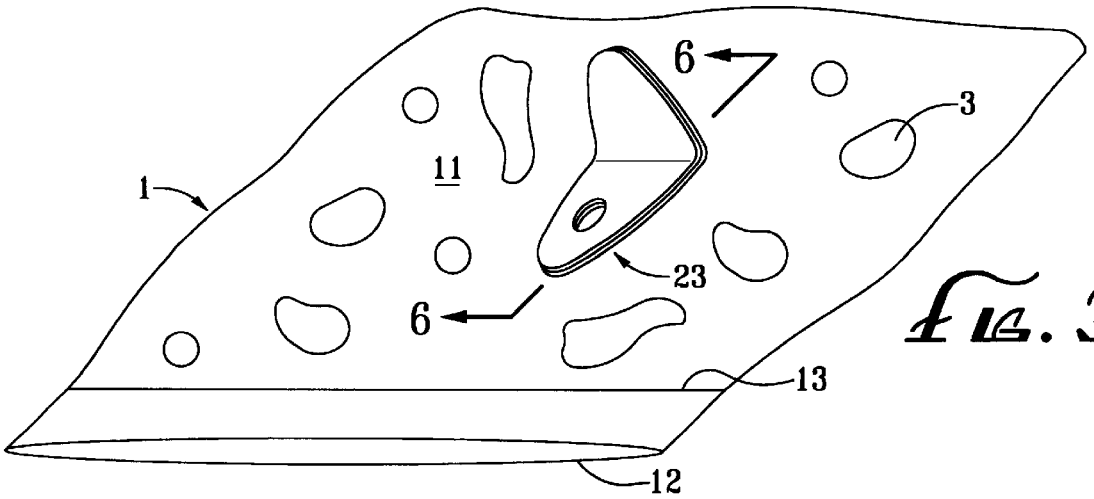
Figure 4:
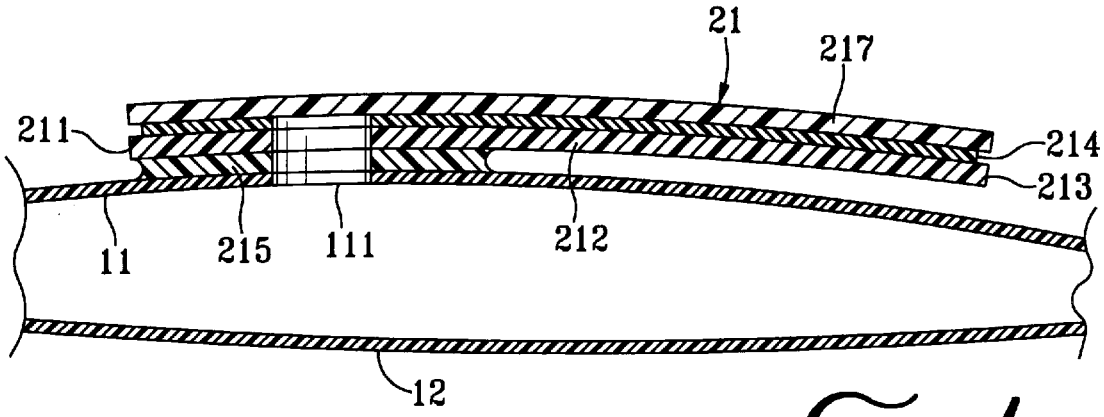
FIGS. 4–6 are diagrammatic partial cross sections taken on lines IV—IV, V—V and VI—VI of FIGS. 1, 2 and 3 respectively.
Figure 5:
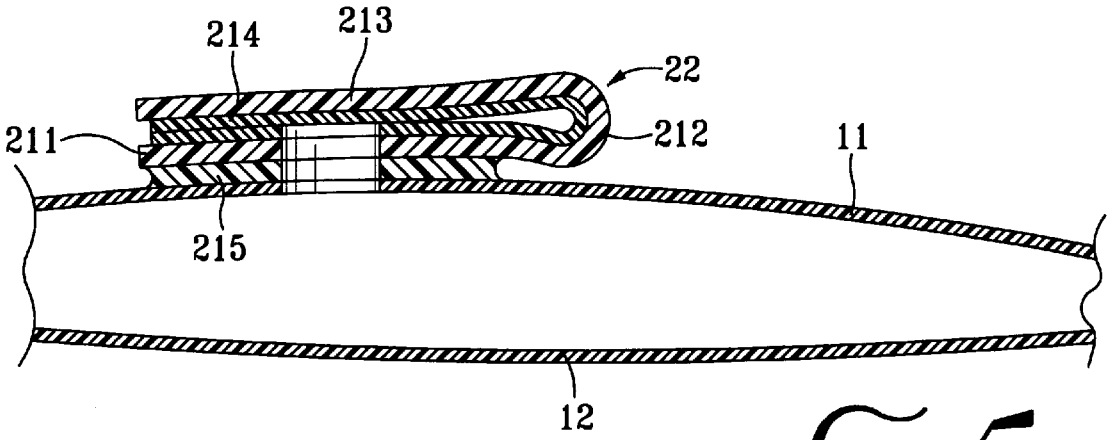
Figure 6:
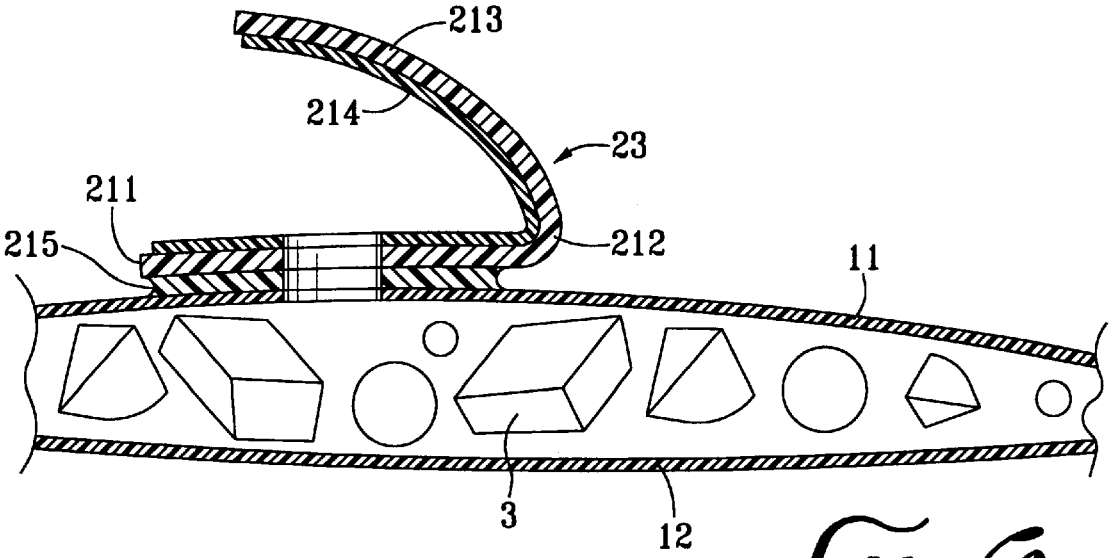

FIGS. 1, 2 and 3 show a flat plastic bag 1 having opposed walls 11 and 12. FIGS. 4 to 6 are cross sections on lines IV—IV, V—V and VI—VI in FIGS. 1,2 and 3 respectively. Wall 11 has an aperture 111 through it. Secured around the aperture 111 is a cover unit which is a precursor unit 21 in FIG. 1, an operating unit 22 in FIG. 2 and an activated unit 23 in FIG. 3. The bag is empty and open in FIGS. 1 and 2, and filled with objects 3 and sealed along line 13 in FIG. 3. As best shown in FIGS. 4–6, the cover unit includes a base member 211, a force member 212, a barrier member 213, and a layer of PSA 214. The members 211, 212 and 213 are different parts of a strip of polymeric material. The base member 211 is secured to the wall 11 around the aperture 111 by a the layer of adhesive 215. layer of adhesive 215, the base member 211, and the layer of PSA 214 have apertures therein which coincide with aperture 111 in the wall 11 of the bag. 1. The precursor unit 21 also includes a release sheet 217. The precursor unit 21 is converted into operational unit 22 by removing the release sheet 217 and folding the strip of polymeric material about its midpoint, thus elastically deforming the force member 212, and then securing the barrier member 213 over the aperture 111. This is done at a temperature which is low enough to insure that the PSA remains on the strip of polymeric material and provides a good bond. The bag is then filled with the cut fruit or other objects 3 to be packaged, and is sealed along line 113. If the sealed package is exposed to elevated temperatures at which weakening of the PSA 214 causes the elastic forces of the force member 212 to exceed the adhesive forces, the barrier member pulls away from the base member, thus venting the package.

Figure 7:
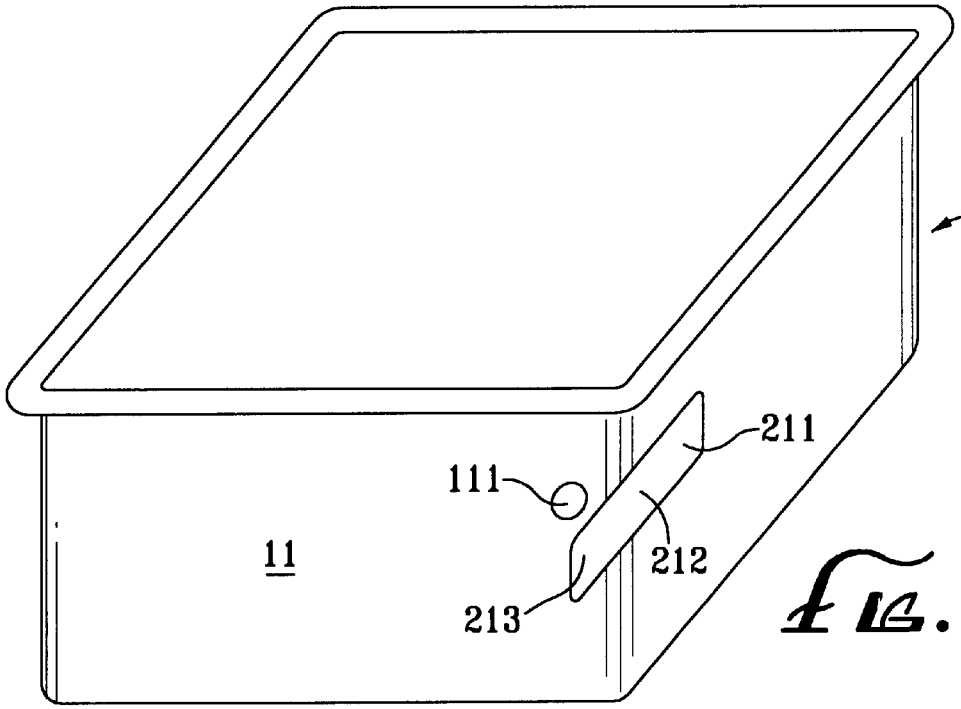
FIGS. 7 and 8 are diagrammatic views of a container (a semi-rigid plastic box) when it is empty and has a precursor cover unit secured thereto (FIG. 7); and after the precursor unit has been made operational and the container has been filled and sealed, but before the package has been exposed to excessive temperature which would cause the barrier member to lift off the window (FIG. 8)
Figure 8:
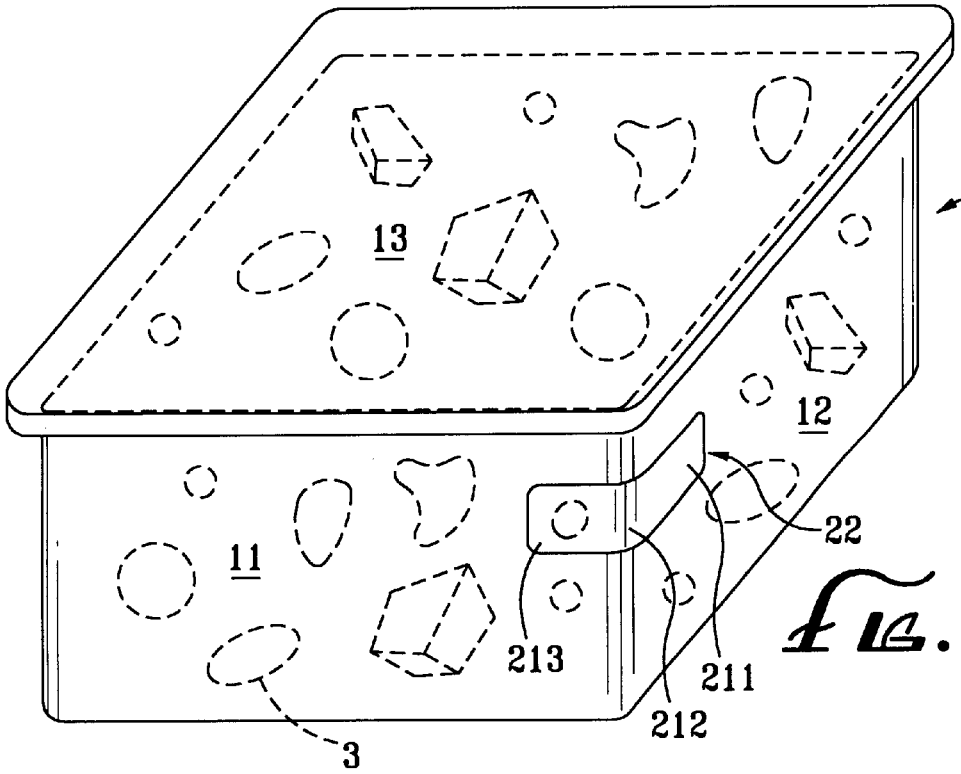

FIGS. 7 and 8 show a thermoformed semi-rigid plastic box 1 having side walls 11 and 12, as well as two other side walls and a bottom wall. Wall 11 has an aperture 111 through it, near the rounded edge at the junction of the walls 11 and 12. Secured to the wall 12 is a cover unit which is a precursor unit 21 in FIG. 6 and an operating unit 22 in FIG. 8. The box is empty and open in FIG. 7, and filled with objects 3 and sealed by a lid 13 in FIG. 8. The cover unit includes a base member 211, a force member 212, a barrier member 213, and a layer of PSA (not shown) on the inner face of the barrier member. The members 211, 212 and 213 are different parts of a strip of polymeric material. The base member 211 is secured to the wall 12 by a layer of adhesive (not shown). The precursor unit 21 is converted into operational unit 22 by folding the strip of polymeric material about its midpoint around the rounded edge at the junction of the walls 11 and 12, thus elastically deforming the force member 212 and securing the barrier member 213 over the aperture 111 through the layer of PSA. This is done at a temperature which is low enough to insure that the PSA provides a good bond. The bag is then filled with the cut fruit or other objects 3 to be packaged, and the lid 13 is sealed to the top of the box 1. If the sealed package is exposed to elevated temperatures at which weakening of the PSA causes the elastic forces of the force member 212 to exceed the adhesive forces, the barrier member pulls away from the base member, thus venting the package.

Figure 9:
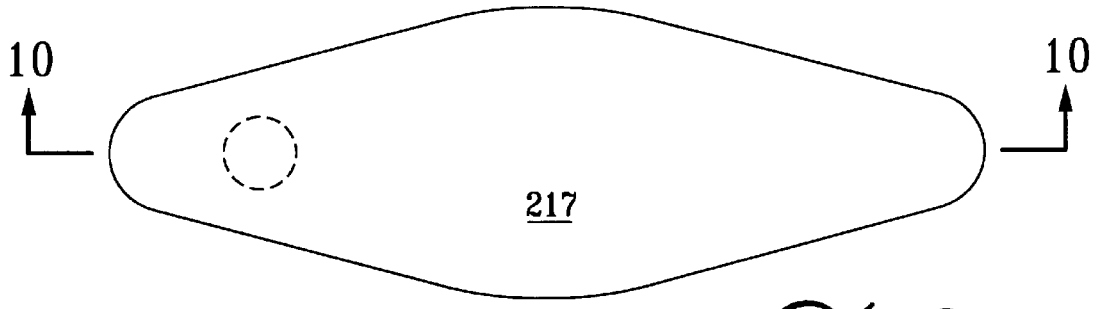
FIGS. 9 and 10 are plan and cross section views of a precursor cover unit suitable for use in FIG. 1.
Figure 10:
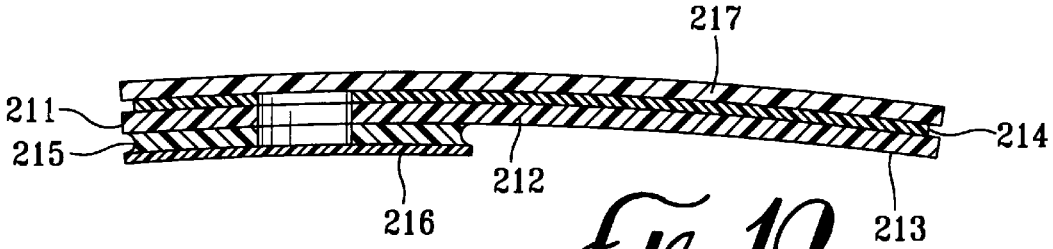

FIGS. 9 and 10 show a precursor cover unit 21 suitable for use in the package of FIG. 1. The precursor unit is the same as that shown in the FIGS. 1 and 4, except that it also includes a release sheet 216 on the face of the layer of adhesive 215 which is to secure the base member 211 to the wall of the container. The adhesive 215 is also a PSA, but it retains its adhesive strength at the temperatures which will cause the barrier member 213 to be pulled off the aperture 111.

Figure 11:
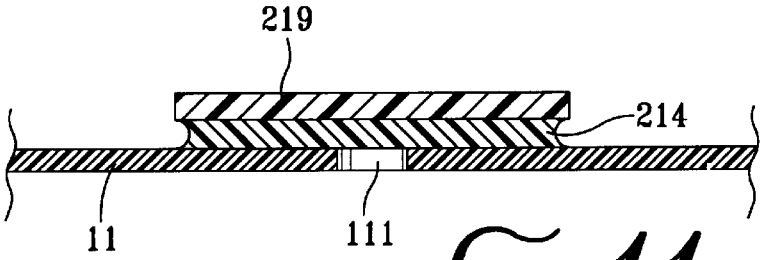
FIG. 11 is a diagrammatic cross section of another operational cover unit attached to a package.

FIG. 11 is a diagrammatic cross-section through another operational cover unit attached to wall 11 of a container. The wall 11 contains an aperture 111 which is covered by the unit. The unit comprises a layer 214 of a PSA and a combined base, force and barrier member 219. The member 219 is a heat-recoverable sheet which, at the storage temperature of the container, is a flat sheet, but which tends to assume a curled configuration if heated above an elevated temperature. Therefore, if the package is heated to a temperature above that elevated temperature and the recovery forces exceed the adhesive forces, the member curls up and exposes the aperture 111.

The invention is illustrated in the following Examples. In the Examples, the following abbreviations are used.

CxA is an n-alkyl acrylate in which the n-alkyl group contains x carbon atoms (e.g. C12A is dodecyl acrylate).

EHA is ethylhexyl acrylate.

AA is acrylic acid.

C12SH is dodecyl mercaptan.

MACDMS is a polydimethylsiloxane terminated at one end only by a methacryloxypropyl group, which is available from Gelest under the trade name MCR M-17.

AIBN is 2,2'-azobis (2-methylpropionitrile).

Esperox is t-amylperoxy-2-ethylhexanoate, which is available from Witco Corp. under the tradename Esperox 570.

Morstik is a styrene butadiene rubber which is available from Morton Chemicals.

PET is polyethylene terephthalate available from du Pont under the trade name Mylar.

Examples A1–A3

In Examples A1–A3, three SCC polymers were prepared. The ingredients and amounts thereof shown in Table 1 were reacted as follows. In Example A1, the ingredients were reacted in two steps under the conditions shown in Table 1. In Examples A2 and A3, the ingredients were reacted in one step under the conditions shown in Table 1.

Examples B1–B3

In Examples B1–B3, products of the invention were made.

Example B1

A container similar to that shown in FIGS. 1 and 4 was made as follows. The siloxane/SCC block copolymer of Example A1 was coated onto a PET film 5.2 mil (0.13 mm) thick to give an adhesive layer about 2.4 mil (0.06 mm) thick. A strip 93×14 mm was cut from the sheet, and a round aperture 12.7 mm in diameter was made in the center of the strip about 16 mm from one end. A similar aperture was made in one wall of a plastic bag. The uncoated side of the half of the strip containing the aperture was secured to the plastic bag, with the apertures coinciding, using a conventional PSA.

The other half of the strip was then folded around a drinking straw into contact with the secured half, thus covering the aperture, generally as shown in FIGS. 2 and 5. The end of the region of adhesion between the two halves could be observed through the top half as a line at right angles to the axis of the strip. At a storage temperature of 1° C., this line moved 15 mm towards the aperture in 7 days. At a storage temperatureof of 5° C. the line moved 24 mm towards the aperture in 24 hours.

Example B2

The polymer made in Example A3 (25 parts) and Morstik (75 parts) were mixed. A layer 2 mil (0.05 mm) thick of the mixture was coated onto a PET film 2 mil (0.05 mm) thick, using a #60 Meyer rod, and dried for 5 hours at 70° C. A 100×100 mm sample was cut from the coated sheet and the coated surface was covered with a siliconized PET sheet. The sample and the cover sheet were wrapped around a 6.3 mm diameter mandrel, with the adhesive on the outside,and then maintained at 80° C. for 10 minutes. The cover sheet was removed, thus producing a curled label. The label could be flattened out and secured by the adhesive over an aperture in a semi-rigid wall of a polymeric container, in the manner shown in FIG. 11, thus blocking the aperture until an increase in temperature caused the elastic recovery forces of the PET film to exceed the adhesive forces.

Example B3

The polymer made in Example A3 (25 parts) and Morstik (75 parts) were mixed. A layer 2 mil (0.05 mm) thick of the resulting adhesive mixture was coated onto a PET film 2 mil (0.05 mm) thick, using a #60 Meyer rod, and dried for 15 minutes at 70° C. A 25×75 mm sample was cut from the coated sheet. A 9.5 mm diameter aperture was made in the rounded edge between two side walls of a semi-rigid polymeric box. At 0° C. the sample could be secured by the adhesive over the aperture, with the length of the sample at right angles to the edge, until increased temperature caused the adhesive forces to be less than the elastic recovery forces produced by bending the sample around the edge.

TABLE 1

| | A1 | A2 | A3 |
|---|---|---|---|
| Monomers | | | |
| C12A | 42.6 | — | — |
| C14A | 17.7 | 60 | 85 |
| C16A | — | 37 | 30 |
| C18A | | | 65 |
| AA | — | 3 | 5 |
| C12SH | — | 3 | 21 |
| MACDMS | 40.1 | — | — |
| PHASE 1 | | | |
| Solvent | | | |
| Heptane | 200 | — | — |
| Initiator | | | |
| AIBN | 0.1 | 0.5 | — |
| Esperox | — | — | 1 |
| Temp (° C.) | 75 | 80 | 100 |
| Time (Hr.) | 4 | 6 | 3 |
| PHASE 2 | | | |
| Initiator | | | |
| Esperox | 0.74 | — | — |
| Temp (° C.) | 100 | — | — |
| Time (Hr.) | 1.5 | — | — |
| Product | | | |
| $M_w$ | — | 10k | 2760 |
| $T_p$ | 6.8 | 25.8 | 36.6 |

What is claimed is:

1. A sealed package which is at a first temperature and which comprises (A) a sealed container which defines an interior space, and (B) a foodstuff which is a biological material within the interior space;

the sealed container comprising (1) walls which (a) define the interior space, and (b) contain a window through which gases can pass into or out of the interior space; and (2) a temperature-sensitive cover unit which comprises (a) a base member which is secured to a wall of the container, (b) a barrier member which is secured over the window and reduces the rate at which gases pass through the window, (c) a layer of an adhesive which secures the barrier member over the window by adhesive forces which decrease if the layer is heated from the first temperature to an elevated temperature, and (d) an elastically deformed force member which exerts elastic recovery forces on the barrier member which (i) tend to move the barrier member so that it uncovers the window, (ii) at the first temperature are insufficient to overcome the adhesive forces which secure the barrier member over the window, and (iii), when the cover unit is heated from the first temperature to the elevated temperature, are sufficient to overcome the adhesive forces which secure the barrier member over the window, so that the force member recovers elastically and causes the barrier member to move so that it uncovers at least part of the window, thereby increasing the rate at which gases pass through the window.

2. A sealed package according to claim 1 wherein the base, and barrier and force members are adjacent parts of a single sheet of polymeric material.

3. A sealed package according to claim 1 wherein the window in the wall is an aperture.

4. A sealed package according to claim 1 wherein the force member causes the barrier member to move and uncover at least part the window before the temperature of the package exceeds 18° C.

5. A sealed package according to claim 4 wherein the adhesive is a pressure sensitive adhesive (PSA) comprising a side chain crystalline (SCC) polymer.

6. A sealed package according to claim 5 wherein the SCC polymer is a block copolymer which (1) has a heat of fusion of at least 5 J/g, and (2) comprises (i) polysiloxane polymeric blocks, and (ii) SCC polymeric blocks having a melting point, $T_p$, of 0 to 20° C.

7. A sealed package according to claim 6 wherein the SCC polymeric blocks have a melting point, $T_p$, of 4 to 10° C.

8. A sealed package according to claim 5 wherein SCC polymer has an onset of melting temperature, $T_o$, such that $T_p - T_o$ is less than 10° C.

9. A sealed package according to claim 5 wherein the PSA comprises (1) at least 50% by weight of a polymeric PSA, and (2) an SCC polymer having a weight average molecular weight of less than 25,000.

10. A sealed package according to claim 1 wherein the biological material is fruit, and the force member causes the barrier member to move and uncover at least part of the window when the package is stored at a temperature above about 10° C.

11. A container which can be sealed around a foodstuff which is a biological material to provide a sealed package containing the biological material, the container comprising (1) walls which (a) when the container has been sealed around the biological material, define an interior space which contains the biological material, and (b) contain a window through which gases can pass into or out of the interior space; and (2) a temperature-sensitive cover unit which comprises (a) a base member which is secured to a wall of the container, (b) a barrier member which can be secured over the window and which, when it is secured over the window, reduces the rate at which gases pass through the window, (c) a layer of an adhesive which, when the barrier member is secured over the window and the container is at a first temperature, secures the barrier member over the window by adhesive forces which decrease if the layer is heated from the first temperature to an elevated temperature, and (d) an elastically deformable force member which, when the barrier member is secured over the window, is elastically deformed and exerts elastic recovery forces on the barrier member which (i) tend to move the barrier member so that it uncovers the window, (ii) at the first temperature are insufficient to overcome the adhesive forces which secure the barrier member over the window, and (iii) when the cover unit is heated from the first temperature to the elevated temperature, are sufficient to overcome the adhesive forces which secure the barrier member over the window, so that the force member recovers elastically and causes the barrier member to move so that it covers at most part of the window, thereby increasing the rate at which gases pass through the window.

12. A container according to claim 11 wherein the base, barrier and force members are adjacent parts of a single sheet of polymeric material.

13. A container according to claim 12 wherein the adhesive is a pressure sensitive adhesive (PSA).

14. A container according to claim 11 wherein the adhesive contains an SCC polymer.

15. A precursor cover unit which is suitable for use in making a container as defined in claim 11 and which comprises (1) a component comprising
  (a) a base member which can be secured to a wall of a container and which has an aperture through it,
  (b) a barrier member, and
  (c) a force member which is elastically deformable;

(2) a first layer of a first pressure-sensitive adhesive (PSA);

(3) a first release sheet covering the first layer of adhesive;

(4) a second layer of a second pressure-sensitive adhesive (PSA) for securing the base member to a wall of a container, the second PSA retaining adhesive strength at elevated temperatures at which the first PSA has reduced adhesive strength; and (5) a second release sheet covering the second layer of adhesive;

whereby, after the first release sheet has been removed, the force member can be elastically deformed so that barrier member is secured to the base member by the PSA and covers the aperture in the base member;

the component and the PSA being such that, when the force member has been elastically deformed so that the barrier member is secured to the base member by the PSA, heating the cover member from a first temperature to an elevated temperature causes
  (i) the PSA layer to lose adhesive strength, and
  (ii) the force member to recover elastically and cause the barrier member to move so that it covers at most part of the aperture in the base member.

16. A cover unit according to claim 15 wherein said component is a strip of polymeric material.

17. A method of making a container according to claim 11 which comprises (A) providing a container comprising walls which can be sealed around a biological material to define an interior space containing the biological material and which contain a window through which gases can pass into or out of the interior space;

(B) providing a precursor cover unit which comprises
  (1) a component comprising
    (a) a base member which can be secured to a wall of the container and which has an aperture through it,
    (b) a barrier member, and
    (c) a force member which is elastically deformable;
  (2) a layer of a pressure-sensitive adhesive (PSA); and
  (3) a release sheet covering the layer of adhesive;

whereby, after the release sheet has been removed, the force member can be elastically deformed so that barrier member is secured to the base member by the PSA and covers the aperture in the base member;

the component and the PSA being such that, when the force member has been elastically deformed so that the barrier member is secured to the barrier member by the PSA, heating the cover member from a first temperature to an elevated temperature causes
  (i) the PSA layer to lose adhesive strength, and
  (ii) the force member to recover elastically and cause the barrier member to move so that it covers at most part of the aperture in the base member; and (C) securing the base member of the cover unit to the wall of the container having the window therein, so that the window in the wall and the aperture in the base member overlap.

18. A method according to claim 17 which comprises removing the release sheet, and then elastically deforming the force member so that the barrier member is secured to the base member by the PSA and covers the aperture in the base member and the window in the wall.

* * * * *